US011439883B2

(12) United States Patent
Felt et al.

(10) Patent No.: US 11,439,883 B2
(45) Date of Patent: Sep. 13, 2022

(54) FOOTBALL SLED ADAPTER

(71) Applicant: Double J Inventors LLC, Loma, CO (US)

(72) Inventors: Jeremy Felt, Loma, CO (US); Jesse Hoisington, Loma, CO (US)

(73) Assignee: Double J Inventors LLC, Loma, CO (US)

( * ) Notice: Subject to any disclaimer, the term of this patent is extended or adjusted under 35 U.S.C. 154(b) by 0 days.

(21) Appl. No.: 17/070,792

(22) Filed: Oct. 14, 2020

(65) Prior Publication Data

US 2021/0106897 A1 Apr. 15, 2021

Related U.S. Application Data

(60) Provisional application No. 62/915,319, filed on Oct. 15, 2019.

(51) Int. Cl.
*A63B 69/34* (2006.01)

(52) U.S. Cl.
CPC ..... *A63B 69/345* (2013.01)

(58) Field of Classification Search
CPC ..... A63B 69/002; A63B 69/34; A63B 69/345
USPC ..... 473/444, 445
See application file for complete search history.

(56) References Cited

U.S. PATENT DOCUMENTS

| | | | | |
|---|---|---|---|---|
| 2,620,188 | A * | 12/1952 | Malagio | A63B 69/345 248/610 |
| 2,913,245 | A * | 11/1959 | Landis | A63B 69/345 482/90 |
| 6,036,609 | A * | 3/2000 | Gilman | A63B 69/345 473/445 |
| 2006/0035734 | A1* | 2/2006 | Borunda | A63B 71/06 473/445 |
| 2013/0184104 | A1* | 7/2013 | Gilman | A63B 69/345 473/445 |

* cited by examiner

*Primary Examiner* — John E Simms, Jr.
*Assistant Examiner* — Rayshun K Peng
(74) *Attorney, Agent, or Firm* — Snell & Wilmer L.L.P.

(57) ABSTRACT

An adapter for a football sled may enable multi-directional movement of a pad of the football sled. That is, the disclosed adapter may comprise a joint coupled between a base and a pad support of the football sled, and the joint may facilitate multi-directional movement of the pad, which is mounted to the pad support, relative to the base. The adapter may also comprise a biasing member coupled to the joint that is configured to bias the joint toward a non-deflected position (e.g., a standard, at rest position).

19 Claims, 5 Drawing Sheets

FOOTBALL SLED ADAPTER

CROSS-REFERENCES TO RELATED APPLICATION

This application claims the benefit of and priority to U.S. Provisional Application No. 62/915,319 filed Oct. 15, 2019 entitled FOOTBALL SLED ADAPTER, which is incorporated herein by reference in its entirety for all purposes.

FIELD

This invention relates to football sleds, and more particularly to a football sled that enables multi-directional movement of a pad of the football sled.

BACKGROUND

Conventional football sleds are designed to help football players develop leg strength and improve overall conditioning. For example, a football player may push against a pad mounted to the football sled in an effort to drive back the football sled. Through this practice, the player is able to improve his strength and ability to perform football maneuvers, such as run-blocking and/or pass-rushing.

However, conventional football sleds have various shortcomings pertaining to teaching players proper techniques. For example, traditional football sleds allow players to lean on the pad, which can cause the player to get his center of mass beyond is toes, lower his head and eyes, and develop other problematic habits.

SUMMARY

The subject matter of the present disclosure has been developed in response to the present state of the art, and in particular, in response to the problems and needs in the art that have not yet been fully solved by currently available football sleds. Accordingly, the present disclosure has been developed to provide an adapter for a football sled that overcomes many or all of the above-discussed shortcomings in the art, in accordance with various embodiments.

Disclosed herein, according to various embodiments, is an adapter for a football sled. The adapter may include a joint configured to be coupled between a base and a pad support of the football sled, the joint configured to enable multi-directional movement of a pad, mounted to the pad support, relative to the base. The adapter may also include a biasing member coupled to the joint and configured to bias the joint toward a non-deflected position.

In various embodiments, the biasing member comprises a spring. The biasing member may comprise at least one of a shock and a strut. The biasing member may include a plurality of shocks or a plurality of struts. In various embodiments, the joint comprises a u-joint or a ball joint. The adapter may further include a deflection limiter coupled to the joint. The deflection limiter may be adjustable to provide a variable range of motion.

Also disclosed herein, according to various embodiments, is a football sled that comprises a base, a pad support, and an adapter. The base may be configured to engage a ground surface, the pad support may extend from a pad, and the adapter may be coupled between the base and the pad support, with the adapter being configured to enable multi-directional movement of the pad relative to the base. In various embodiments, the multi-directional movement comprises at least pitch and roll of the pad relative to the base. The multi-directional movement may further include yaw of the pad relative to the base.

Also disclosed herein, according to various embodiments, is a method of assembling a football sled. The method may include coupling a first portion of a joint of an adapter to a base of the football sled. The method may also include coupling a second portion of the joint of the adapter to a pad support of the football sled, wherein the adapter is configured to enable multi-directional movement of the first portion of the joint relative to the second portion of the joint. In various embodiments, the method further includes comprising coupling a biasing member to the joint of the adapter. In various embodiments, the method includes coupling a deflection limiter to the adapter.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Thus, although the subject matter of the present disclosure is particularly pointed out and distinctly claimed in the concluding portion of the specification, a more complete understanding of the present disclosure, may best be obtained by referring to the detailed description and claims when considered in connection with the drawing figures. Understanding that these drawings depict only typical embodiments of the disclosure and are not therefore to be considered to be limiting of its scope, the subject matter of the present application will be described and explained with additional specificity and detail through the use of the accompanying drawings, in which:

DETAILED DESCRIPTION

Figure 1:
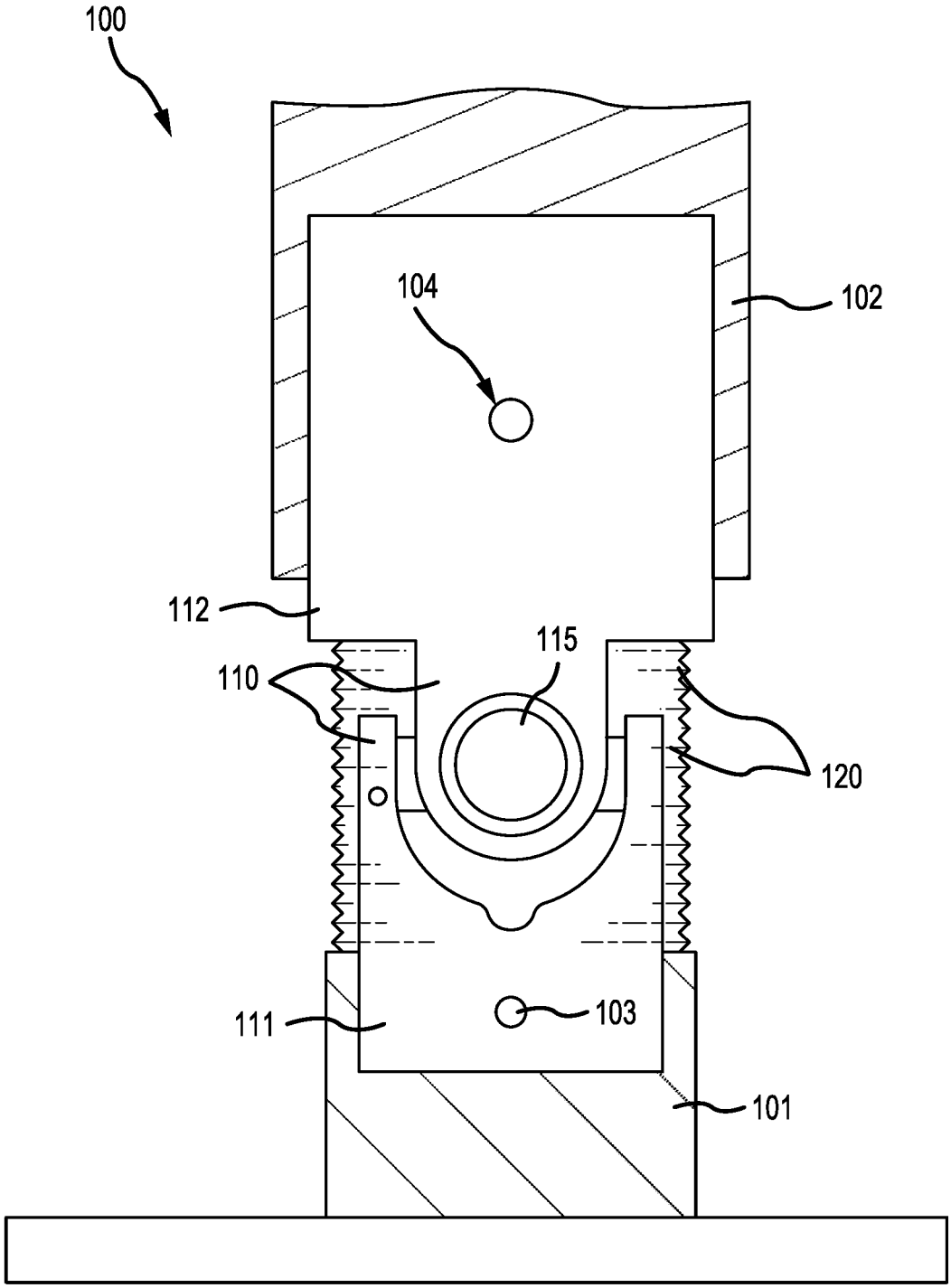
FIG. 1 is a schematic depiction of an adapter for a football sled, with the adapter comprising an external spring and a u-joint, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein, the terms "including," "comprising," "having," and variations thereof mean "including but not limited to" unless expressly specified otherwise. Accordingly, the terms "including," "comprising," "having," and variations thereof are intended to cover a non-exclusive inclusion, such that a process, method, article, or apparatus that comprises a list of elements does not include only those elements but may include other elements not expressly listed or inherent to such process, method, article, or apparatus. An enumerated listing of items does not imply that any or all of the items are mutually exclusive and/or mutually inclusive, unless expressly specified otherwise.

Further, in the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Thus, when a particular feature, structure, or characteristic is described in connection with an embodiment, it is submitted that it is within the knowledge of one skilled in the art to affect such feature, structure, or characteristic in connection with other embodiments whether or not explicitly described. Similarly, the use of the term "implementation" means an implementation having a particular feature, structure, or characteristic described in connection with one or more embodiments of the present disclosure. Absent an express correlation to indicate otherwise, an implementation may be associated with one or more embodiments. After reading the description, it will be apparent to one skilled in the relevant art(s) how to implement the disclosure in alternative embodiments.

Disclosed herein, according to various embodiments, is an adapter for a football sled that enables multi-directional movement of a pad of the football sled. That is, the adapter may comprise a joint coupled between a base and a pad support of the football sled, and the joint may facilitate multi-directional movement of the pad, which is mounted to the pad support, relative to the base. The adapter may also comprise a biasing member coupled to the joint that is configured to bias the joint toward a non-deflected position (e.g., a standard, at rest position), as described in greater detail below.

The adapter may provide the aforementioned strength training and conditioning benefits while preventing football players from developing improper techniques. That is, the adapter disclosed herein helps players to practice staying in a balanced and safe position, with their head and eyes up during drills, according to various embodiments. For example, players practicing blocking on a football sled with the adapter will have to use proper hand technique, keep a wide base, and stay on balance while still driving/pushing against the pad. Thus, the multi-directional movement enabled by the adapter simulates what an opposing player would do, and thus better prepares a player for live, in-game scenarios, thereby not only improving the technique and success of the player, but also increasing the safety of the football players.

In various embodiments, the adapter may be utilized as a retrofit for an existing football sled. In various embodiments, a new-build football sled incorporates the adapter. Generally, a football sled includes a base, configured to engage a ground surface, and a pad support extending to/from a pad. That is, the base of the football sled may include the framework configured to support the football sled against the ground, and the pad support may comprise the structure and features that are configured to hold the pad in a desired position. The adapter, according to various embodiments, is generally configured to be coupled between the base and the pad support to provide and enable the multi-directional movement of the pad (coupled to the pad support) relative to the base.

The multi-directional movement enabled by the adapter may comprise movement along and/or about at least two different axes. That is, the multi-directional movement of the adapter may allow for the pad of the football sled to not only translate in a linear direction (as some conventional sleds), but facilitates bending/rotation of the pad about one or more axes. For example, the pad of the football sled may have a vertical axis, a transverse axis, and an impact axis. The vertical axis may be defined generally as the axis that extends substantially vertically (relative to the ground surface upon which the football sled is supported), the transverse axis may be generally defined as a horizontal axis or as the axis that extends across the front surface of the pad in a horizontal direction, and the impact axis may be defined as the axis extending through the front surface of the pad that is perpendicular to both the vertical axis and the transverse axis (e.g., extends in the direction of the impact/force from the player driving his body into the pad). In various embodiments, rotation of the pad about the vertical axis is referred to as yaw, rotation/deflection of the pad about the transverse axis is referred to as pitch, and rotation/deflection of the pad about the impact axis is referred to as roll. In various embodiments, the multi-directional movement enabled by the adapter comprises at least pitch and roll of the pad relative to the base. In various embodiments, the multi-directional movement also comprises yaw of the pad relative to the base.

FIGS. 1, 2, 3, and 4 are schematic depictions of various features of the adapter, according to various embodiments. With reference to FIG. 1, the adapter 100 includes a joint 110 and a biasing member 120, according to various embodiments. The joint 110 may include a first portion 111 coupled to a base 101 of the football sled and a second portion 112 coupled to a pad support 102 of the football sled. The first portion 111 of the joint 110 may be coupled to the base 101 using a fastener 103 (e.g., a pin) and the second portion 112 of the joint 110 may be coupled to the pad support 102 via a fastener 104 (e.g., a pin). As mentioned above, the adapter 100 may be configured to retrofit an existing football sled, and thus instead of the base 101 connecting directly to the pad support 102, the adapter 100 (i.e., the joint 110) may be interposed between the two to provide the multi-directional movement. In various embodiments, the adapter 100 may be constructed of metal materials. For example, the joint 110 may be constructed from a steel material, among others.

The biasing member 120 may be an spring, such as an external coilover spring. The biasing member 120 may surround at least a pivoting section of the joint 110 (as described below). The biasing member 120 may surround this pivoting section. The biasing member may be compressed between two opposing facing surfaces, such as an upper surface and a lower surface. For example, and as shown in FIG. 1, the upper surface may be a shoulder of the second portion 112 of the joint 110 and the lower surface may be a top surface of the base 101. In various embodiments, the top surface of the base 101 comprises an annular structure surrounding a socket that receives the first portion 111 of the joint 110.

The joint 110 may be a u-joint (e.g., a universal joint) such that the first and second portions 111, 112 comprise a pair of hinges connected together via a cross shaft 115. The joint 110 may facilitate relative movement/deflection/rotation of the pad support 102 (and the pad coupled thereto) relative to the base 101. In various embodiments, the biasing member 120 of the adapter 100 is an external spring extending around the cross shaft 115 and may be compressed between opposing surfaces of the assembly. The spring may provide resistance to the deflecting motion of the pad support 102, and/or may be configured to limit the deflection of the pad support 102. In various embodiments, as mentioned above, the adapter 100 may be configured to enable pitch and roll type motion for the pad support. In various embodiments, the connection between the joint 110 and at least one of the base 101 and the pad support 102 may be configured to allow a degree or rotation about the vertical axis, thus providing at least a degree of yaw movement.

Figure 2:
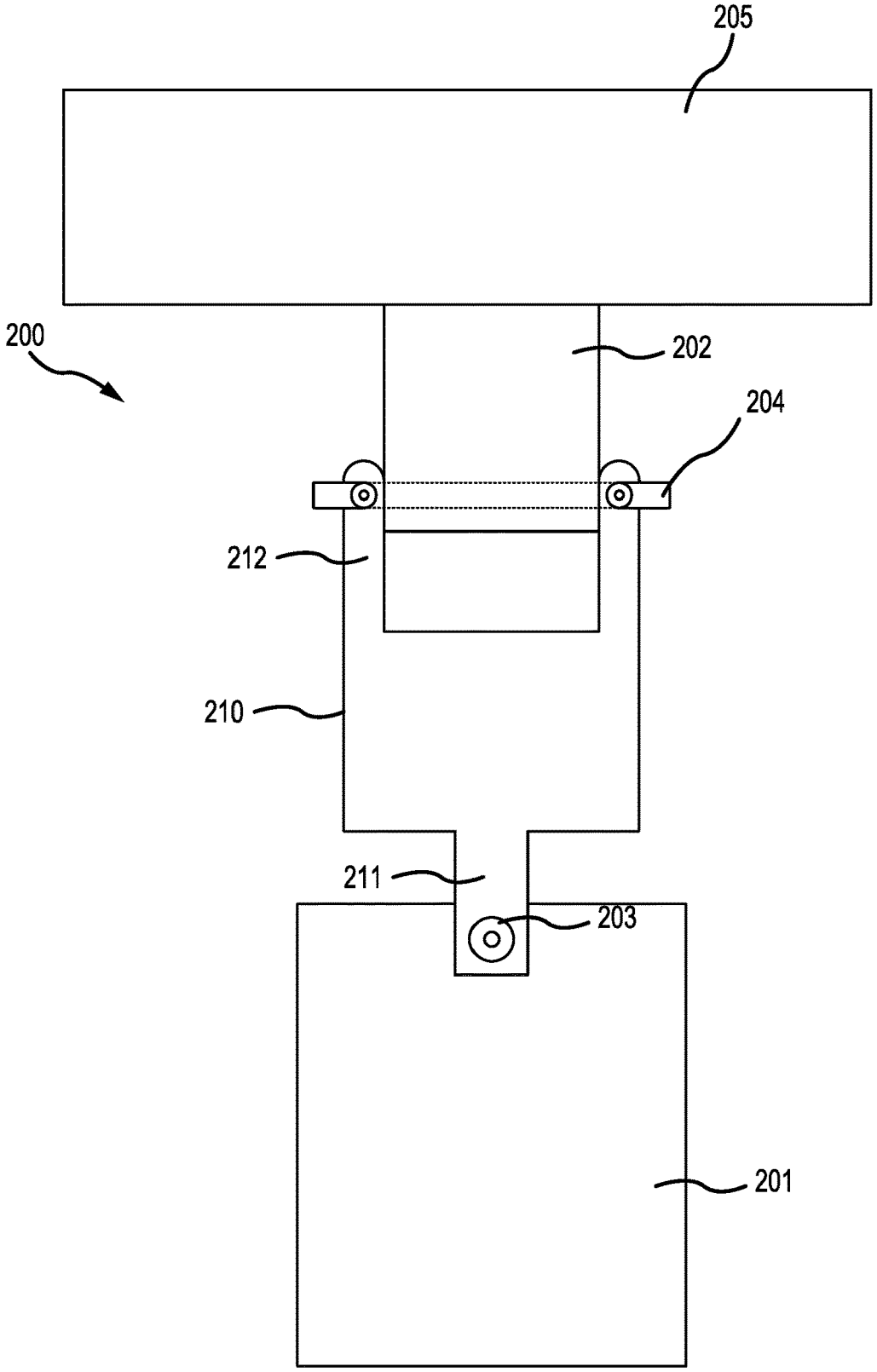
FIG. 2 is a schematic depiction of an adapter for a football sled, with the adapter comprising a u-joint, in accordance with various embodiments.

In various embodiments, and with reference to FIG. 2, the adapter 200 includes a joint 210 and a biasing member. The joint 210 may include a first portion 211 coupled to a base 201 of the football sled and a second portion 212 coupled to a pad support 202 of the football sled (with a pad 205 coupled to the pad support 202). The first portion 211 of the joint 210 may be rotatably coupled to the base 201 via pin 203 and the second portion 212 of the joint 210 may be rotatably coupled to the pad support 202 via pin 204. The pins 203, 204 may be orthogonal to each other, and thus may provide pitch and roll type movement.

In various embodiments, the biasing member of the adapter 200 may include internal spring mechanisms implemented at the rotational interface between the joint 210 and the football sled, thereby providing the aforementioned resistance, biasing the pad 205 of the football sled to the upright/standard position, and/or limiting the deflection of the pad 205 relative to the base 201. For example, the adapter 200 may include torsion springs disposed around the pins 203, 204 of the joint 210, and in response to mechanical energy from a player impacting the pad 205, the torsion springs may be configured to exert a torque in a direction opposite the direction of the mechanical energy, thus helping to resist the impact force and return the pad from a deflected position to an upright position.

Figure 3:
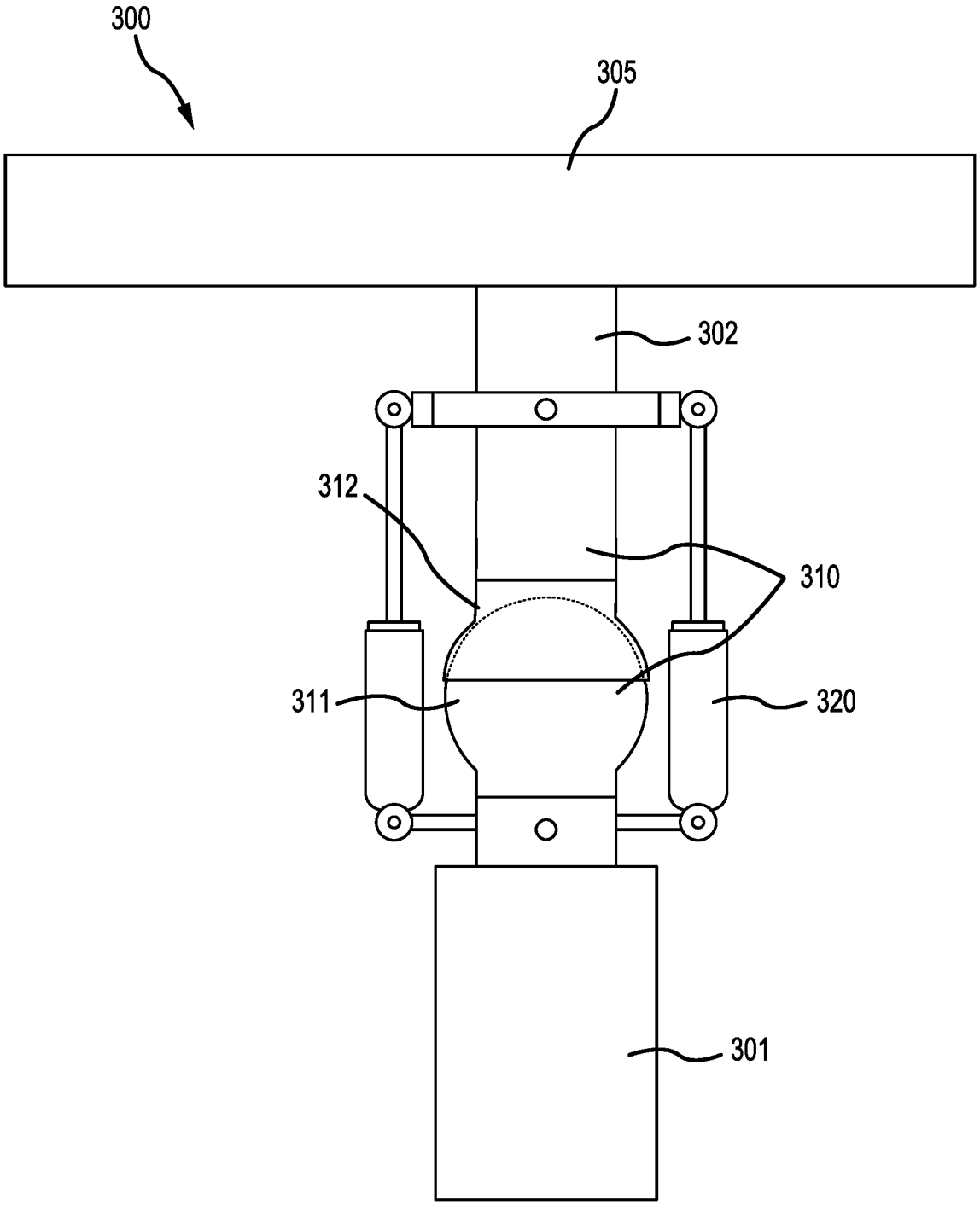
FIG. 3 is a schematic depiction of an adapter for a football sled, with the adapter comprising a ball joint, in accordance with various embodiments.

In various embodiments, and with reference to FIG. 3, the adapter 300 includes a joint 310 and a biasing member 320. The joint 310 may be a ball joint comprising a ball 311 and a socket 312. For example, the ball 311 may be coupled to a base 301 of the football sled and the socket 312 may be coupled to a pad support 302 of the football sled (with a pad 305 coupled to the pad support 302). Engagement between the ball 311 and the socket 312 may enable the multi-directional movement. In various embodiments, the interface between the ball 311 and the socket 312 may be direct contact. In various embodiments, grease or other lubricant may be configured to be utilized in the interface between the ball 311 and the socket 312 to facilitate relative rotation.

In various embodiments, the biasing member 320 of the adapter 300 includes a shock or a strut, thereby providing the aforementioned resistance, biasing the pad 305 of the football sled to the upright/standard position, and/or limiting the deflection of the pad 305 relative to the base 301. In various embodiments, the biasing member 320 includes a series of shocks or struts circumferentially distributed around the ball joint. Although two biasing members are shown, the depiction of FIG. 3 is merely a schematic depiction of the adapter 300, and thus in practice it is likely that three or more biasing members 320 are circumferentially disposed around the joint 310.

Figure 4:
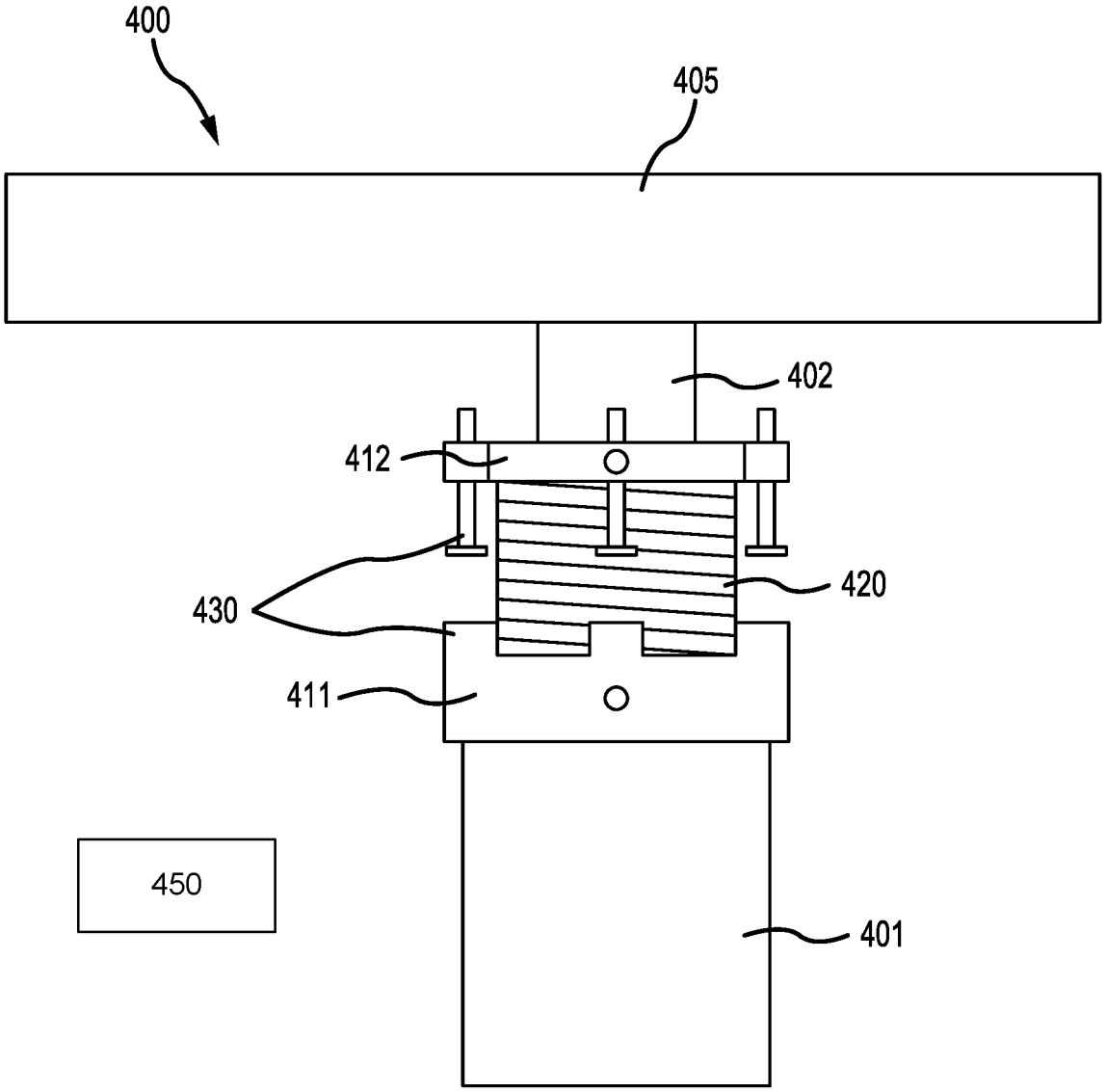
FIG. 4 is a schematic depiction of an adapter for a football sled, with the adapter comprising a deflection limiter, in accordance with various embodiments.

In various embodiments, and with reference to FIG. 4, the adapter 400 includes a biasing member and a deflection limiter 430. In such an embodiment, the spring 420 functions as the joint. That is, the spring 420 may extend between the base 401 and the pad support 402 of the football sled (with pad 405 coupled to the pad support 402). The adapter 400 may include a first and second mounting plate 411, 412, with the deflection limiter 430 extending at least partially between the mounting plates 411, 412. The deflection limiter 430 may include a series of adjustable legs and corresponding stops that limit the deflection of the pad support 402 (and pad 405). In various embodiments, the deflection limiter 430 may be adjustable, thus allowing the deflection limiter 430 to provide a variable range of motion. Thus, in various embodiments, each of the adjustable legs may be independently adjustable, thus allowing a user to select the deflection limits in certain directions. For example, rearward pitch of the pad 405 may be limited by adjusting rear legs to be closer to the opposing plate while lateral legs may be adjusted to have a larger gap, thus allowing a comparatively higher extent of deflection in the lateral directions.

In various embodiments, details from one of the figures may be combined and/or incorporated with details from one of the other figures. Accordingly, structure, features, properties, and/or functionality described with reference to one of the figures may be utilized and otherwise implemented in conjunction with structure, features, properties, or functionality of the other figures.

In various embodiments, the adapter and/or the football sled may be configured with a mechanism to allow a coach/trainer to adjust the range and/or resistance of motion of the adapter, thereby allowing the coach/trainer to customize and vary the player's training with the football sled. For example, the joint, biasing member, or deflection limiter of the adapter may be adjustable to allow the coach/trainer to customize the dynamics of the multi-directional movement. For example, the adapter may be configured to allow the coach/trainer to lock or at least limit one of the rotational axes, thereby preventing or limiting the degree of motion in one direction. The ability to change/customize the degree and resistance of motion may further facilitate players' training. For example, the motion of the pads of the football sled may be adjusted (via the adapter) based on whether the players are practicing pass-blocking or run-blocking.

In various embodiments, and with reference to FIG. 4, the adapter or the football sled may include a controller 450, or may at least be in electric communication with a controller. The controller 450 may include a processor and a memory, as described in greater detail below, to facilitate automated control of the operation of the adapter/football sled. Thus, the various components of the embodiments of the adapter described above may include actuators or other mechanisms in electric communication with the controller, thereby allowing the controller to control the actuators to affect a desired operating condition. The controller 450 may include a user interface that allows the user to manually select the motion resistance properties of the adapter, or the controller 450 may include coded programs that vary and/or change the motion resistance properties of the adapter, thus further improving the effectiveness of the training provided.

In various embodiments, the controller may be integrated into a separate, remote computer system (such as a computer system that runs a plurality of football sleds), or the controller may be a standalone controller. In various embodiments, the controller comprises a processor. In various embodiments, the controller is implemented in a single processor. In various embodiments, the controller may be implemented as and may include one or more processors and/or one or more tangible, non-transitory memories and be capable of implementing logic. Each processor can be a general purpose processor, a digital signal processor (DSP), an application specific integrated circuit (ASIC), a field programmable gate array (FPGA) or other programmable logic device, discrete gate or transistor logic, discrete hardware components, or any combination thereof. Furthermore, any number of conventional techniques for electronics configuration, signal processing and/or control, data processing and the like may be employed. Also, the processes, functions, and instructions may can include software routines in conjunction with processors, etc.

The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

The one or more processors may be configured to implement various logical operations in response to execution of instructions, for example, instructions stored or loaded on the tangible, non-transitory, computer-readable medium configured to communicate with the controller. The system program instructions may include instructions that, in response to execution by a processor, cause the controller or article of manufacture to perform various operations.

Figure 5:
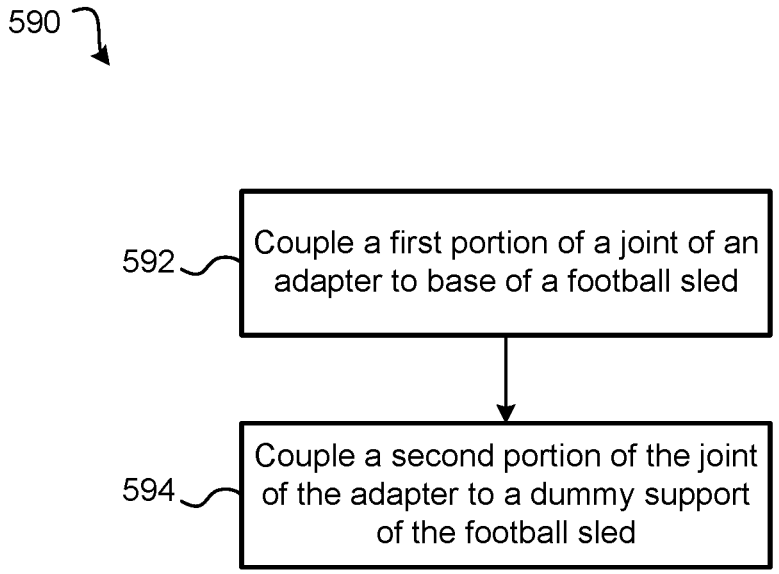
FIG. 5 is a schematic flow chart diagram of a method of assembling a football sled apparatus, in accordance with various embodiments.

In various embodiments, and with reference to FIG. 5, a method 590 of assembling a football sled is provided. The method 590 may include coupling a first portion of a joint of an adapter to a base of the football sled at step 592 and coupling a second portion of the joint of the adapter to a pad support of the football sled at step 594. The adapter may be configured to enable multi-directional movement of the first portion of the joint relative to the second portion of the joint. In various embodiments, the method 590 may further include coupling a biasing member to the joint of the adapter and/or coupling a deflection limiter to the adapter.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. No claim element is intended to invoke 35 U.S.C. 112(f) unless the element is expressly recited using the phrase "means for."

The scope of the disclosure is to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. Further, the term "plurality" can be defined as "at least two." As used herein, the phrase "at least one of", when used with a list of items, means different combinations of one or more of the listed items may be used and only one of the items in the list may be needed. The item may be a particular object, thing, or category. Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A, B, and C. In some cases, "at least one of item A, item B, and item C" may mean, for example, without limitation, two of item A, one of item B, and ten of item C; four of item B and seven of item C; or some other suitable combination.

All ranges and ratio limits disclosed herein may be combined. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Different cross-hatching may be used throughout the figures to denote different parts but not necessarily to denote the same or different materials. Surface shading lines may be used throughout the figures to denote different parts or areas but not necessarily to denote the same or different materials. In some cases, reference coordinates may be specific to each figure. Furthermore, the connecting lines shown in the various figures contained herein are intended to represent exemplary functional relationships and/or physical couplings between the various elements. It should be noted that many alternative or additional functional relationships or physical connections may be present in a practical system.

Any reference to attached, fixed, connected or the like may include permanent, removable, temporary, partial, full and/or any other possible attachment option. Additionally, any reference to without contact (or similar phrases) may also include reduced contact or minimal contact. In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The schematic flow chart diagrams included herein are generally set forth as logical flow chart diagrams. As such, the depicted order and labeled steps are indicative of one or more embodiments of the presented method. The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Furthermore, no element, component, or method step in the present disclosure is intended to be dedicated to the public regardless of whether the element, component, or method step is explicitly recited in the claims.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An adapter for a football sled, the adapter comprising:

a joint configured to be coupled between a base and a pad support of the football sled, the joint configured to enable multi-directional movement of a pad, mounted to the pad support, relative to the base; and a biasing member coupled to the joint and configured to bias the joint toward a non-deflected position;

wherein the football sled is configured to be pushed from a front side of the football sled parallel to an impact axis extending through a front surface of the pad support;

wherein the joint comprises:

a first portion rotatably coupled to the base via a first pin; and a second portion rotatably coupled to the pad support via a second pin, wherein the first pin is oriented orthogonal with respect to the second pin.

2. The adapter of claim 1, wherein the biasing member comprises a spring.

3. The adapter of claim 1, wherein the biasing member comprises at least one of a shock and a strut.

4. The adapter of claim 3, wherein the at least one of a shock and a strut comprises a plurality of shocks or a plurality of struts.

5. The adapter of claim 1, wherein the joint comprises a u-joint.

6. The adapter of claim 1, wherein the joint comprises a ball joint.

7. The adapter of claim 1, further comprising a deflection limiter coupled to the joint.

8. The adapter of claim 7, wherein the deflection limiter is adjustable to provide a variable range of motion.

9. A football sled comprising:

a base configured to engage a ground surface;

a pad support extending from a pad; and an adapter coupled between the base and the pad support, wherein the adapter comprises a joint, a first portion of the joint is rotatably coupled to the base via a first pin, and a second portion of the joint is rotatably coupled to the pad support via a second pin, wherein the first pin is oriented orthogonal with respect to the second pin, the adapter configured to enable multi-directional movement of the pad relative to the base;

wherein the football sled is configured to be pushed from a front side of the football sled parallel to an impact axis extending through a front surface of the pad.

10. The football sled of claim 9, wherein the multi-directional movement comprises at least pitch and roll of the pad relative to the base.

11. The football sled of claim 9, wherein the multi-directional movement further comprises yaw of the pad relative to the base.

12. A method of assembling a football sled, the method comprising:

coupling a first portion of a joint of an adapter to a base of the football sled with a first pin; and coupling a second portion of the joint of the adapter to a pad support of the football sled with a second pin, wherein the first pin is oriented orthogonal with respect to the second pin, the adapter is configured to enable multi-directional movement of the first portion of the joint relative to the second portion of the joint, and the football sled is configured to be pushed parallel to an impact axis extending through a front surface of the pad support.

13. The method of claim 12, further comprising coupling a biasing member to the joint of the adapter.

14. The method of claim 12, further comprising coupling a deflection limiter to the adapter.

15. The adapter of claim 7, wherein the deflection limiter comprises an adjustable leg and a corresponding stop configured to limit the deflection of the pad support.

16. The adapter of claim 1, wherein the biasing member surrounds the joint.

17. The adapter of claim 2, wherein the spring comprises a coil spring and the joint is configured to be received at least partially within the coil spring.

18. The adapter of claim 3, wherein the joint comprises a ball joint, and the at least one of a shock and a strut comprises a plurality of shocks or a plurality of struts circumferentially distributed around the ball joint.

19. The adapter of claim 1, wherein the biasing member is configured to be compressed between a first surface of the second portion and a second surface of the base, and the first surface and the second surface are opposing facing surfaces.

* * * * *